US011673012B2

(12) United States Patent
Bellaus

(10) Patent No.: US 11,673,012 B2
(45) Date of Patent: Jun. 13, 2023

(54) TREE-MOUNTED WORKOUT STATION

(71) Applicant: James William Bellaus, Raritan, NJ (US)

(72) Inventor: James William Bellaus, Raritan, NJ (US)

( * ) Notice: Subject to any disclaimer, the term of this patent is extended or adjusted under 35 U.S.C. 154(b) by 0 days.

(21) Appl. No.: 17/452,643

(22) Filed: Oct. 28, 2021

(65) Prior Publication Data

US 2022/0203151 A1 Jun. 30, 2022

Related U.S. Application Data

(60) Provisional application No. 63/199,433, filed on Dec. 28, 2020.

(51) Int. Cl.

| | |
|---|---|
| ***A63B 21/00*** | (2006.01) |
| ***A63B 21/16*** | (2006.01) |
| ***A63B 23/12*** | (2006.01) |
| ***A63B 1/00*** | (2006.01) |

(52) U.S. Cl.

CPC ..... *A63B 1/00* (2013.01); *A63B 21/16* (2013.01); *A63B 21/4035* (2015.10); *A63B 23/12* (2013.01)

(58) Field of Classification Search

CPC ..... A63B 1/00; A63B 21/16; A63B 21/4035; A63B 71/023

See application file for complete search history.

(56) References Cited

U.S. PATENT DOCUMENTS

| | | | | |
|---|---|---|---|---|
| 3,757,826 | A * | 9/1973 | Kroll | F16B 7/00 138/89 |
| 4,934,693 | A * | 6/1990 | Santoro | A63B 21/0626 482/104 |
| 5,468,205 | A | 11/1995 | McFall et al. | |
| 6,059,698 | A | 5/2000 | Mazor | |
| 7,651,448 | B2 | 1/2010 | Hetrick | |
| 9,028,381 | B2 | 5/2015 | Mestemaker | |
| 9,044,641 | B2 * | 6/2015 | Velikin | A63B 21/068 |
| 9,084,914 | B1 | 7/2015 | Hoffman | |
| 9,149,677 | B2 | 10/2015 | Rountree et al. | |
| 9,242,137 | B1 | 1/2016 | Hoffman | |
| 9,662,527 | B2 | 5/2017 | Slayton | |
| 10,035,036 | B2 | 7/2018 | DiMartino | |
| 10,456,612 | B2 | 10/2019 | McGhee | |
| 10,737,136 | B2 | 8/2020 | Burkinshaw | |
| 2003/0186792 | A1 | 10/2003 | Keeler | |
| 2004/0087420 | A1 | 5/2004 | Montesquieux | |
| 2015/0024907 | A1 * | 1/2015 | Ross | A63B 21/1636 482/39 |
| 2016/0045777 | A1 * | 2/2016 | Haggard | A63B 21/16 482/104 |
| 2017/0259101 | A1 * | 9/2017 | Im | A63B 1/00 |
| 2017/0354838 | A1 * | 12/2017 | Fitzpatrick | A63B 1/00 |

(Continued)

*Primary Examiner* — Andrew S Lo

(74) *Attorney, Agent, or Firm* — Dunlap Bennett & Ludwig, PLLC; Anna L. Kinney

(57) ABSTRACT

A workout station includes a main body, a main beam, a bar, and mounting fasteners. The main beam extends from the main body. The bar extends perpendicularly through the main beam opposite the main body. The mounting fasteners extend through the main body and fasten the workout station to a vertical substrate. The main body, the main beam, the bar, and the mounting fasteners support a user hanging from the bar. The main body secures the workout station to a tree or pole at a predetermined position.

7 Claims, 5 Drawing Sheets

(56) References Cited

U.S. PATENT DOCUMENTS

| | | | | |
|---|---|---|---|---|
| 2018/0185690 | A1 | 7/2018 | Coulter | |
| 2018/0207463 | A1* | 7/2018 | McGhee | A63B 23/1218 |
| 2019/0046835 | A1* | 2/2019 | Henniger | A63B 23/1218 |
| 2019/0388721 | A1* | 12/2019 | Schlegel | A63B 69/34 |
| 2022/0168611 | A1* | 6/2022 | Rogers | A63B 21/00047 |

* cited by examiner

TREE-MOUNTED WORKOUT STATION

CROSS-REFERENCE TO RELATED APPLICATION

This application claims the benefit of priority of U.S. provisional application No. 63/199,433, filed Dec. 28, 2020, the contents of which are herein incorporated by reference.

BACKGROUND OF THE INVENTION

The present invention relates to exercise equipment and, more particularly, to a tree-mounted workout station.

Pull-ups and various other exercises cannot be performed from a single tree. No tree-mounted workout stations are commercially available.

As can be seen, there is a need for a tree-mounted workout station.

SUMMARY OF THE INVENTION

The present invention provides a tree- or pole-mounted workout station with a 90-degree angle base to secure the workout station to the tree or pole at a predetermined position. It may be mounted at any height so that even the tallest person may hang and stretch. It is so strong that two people may hang and workout at the same time.

In one aspect of the present invention, a workout station, comprising: a main body; a main beam extending from the main body; a bar extending perpendicularly through the main beam opposite the main body; and mounting fasteners extending through the main body and operative to fasten the workout station to a vertical substrate; wherein the main body, the main beam, the bar, and the mounting fasteners are operative to support a user hanging from the bar.

These and other features, aspects and advantages of the present invention will become better understood with reference to the following drawings, description, and claims.

DETAILED DESCRIPTION OF THE INVENTION

Figure 1:
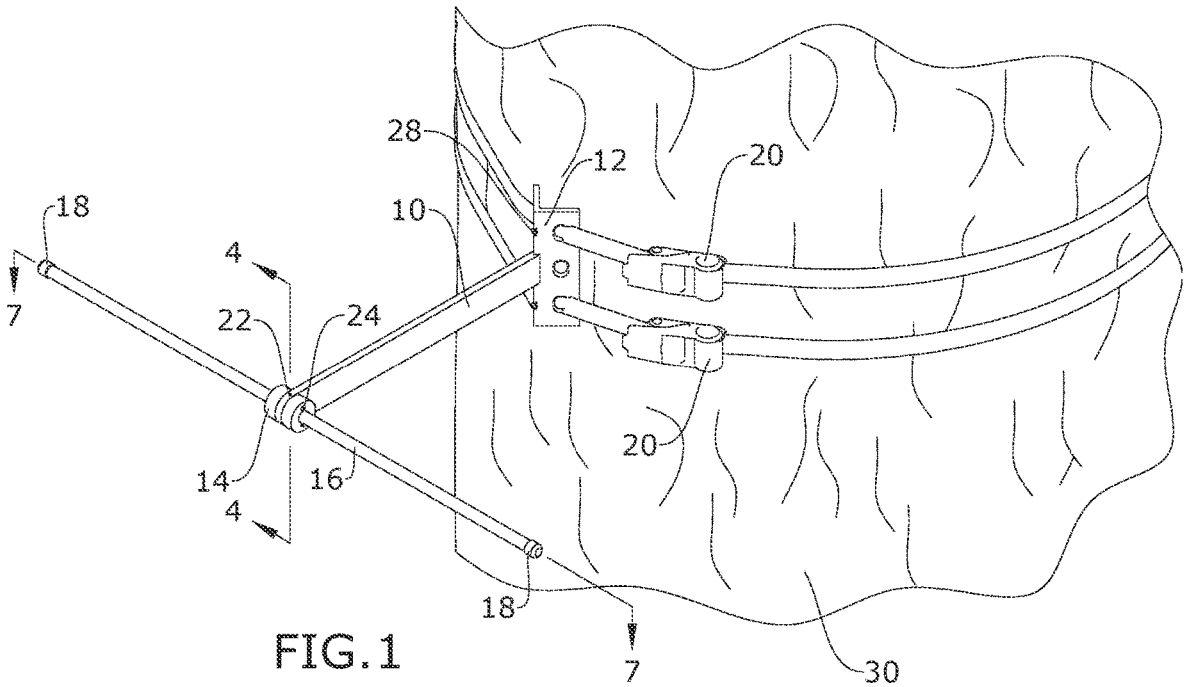
FIG. 1 is a perspective view of a workout station according to an embodiment of the present invention, shown in use position.
Figure 2:
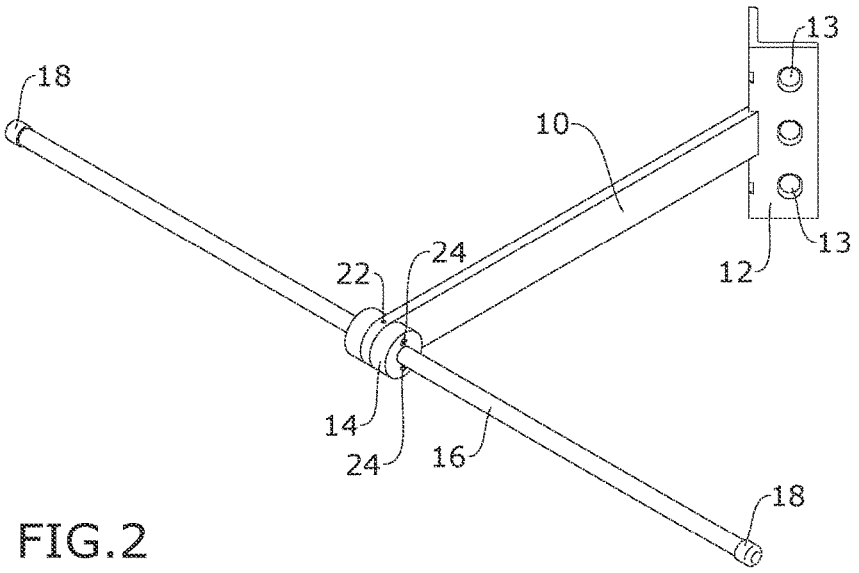
FIG. 2 is another perspective view thereof.
Figure 3:
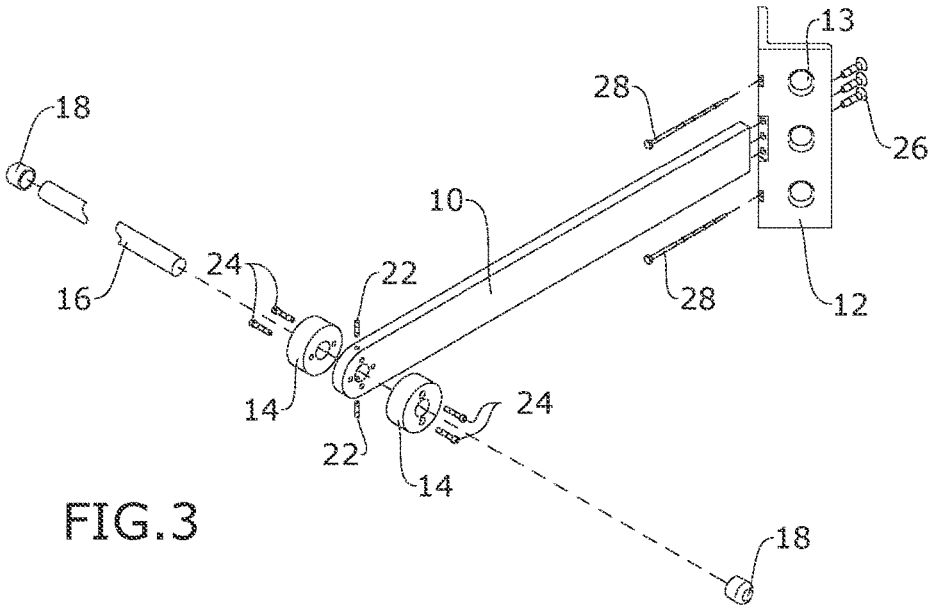
FIG. 3 is an exploded view thereof.
Figure 4:
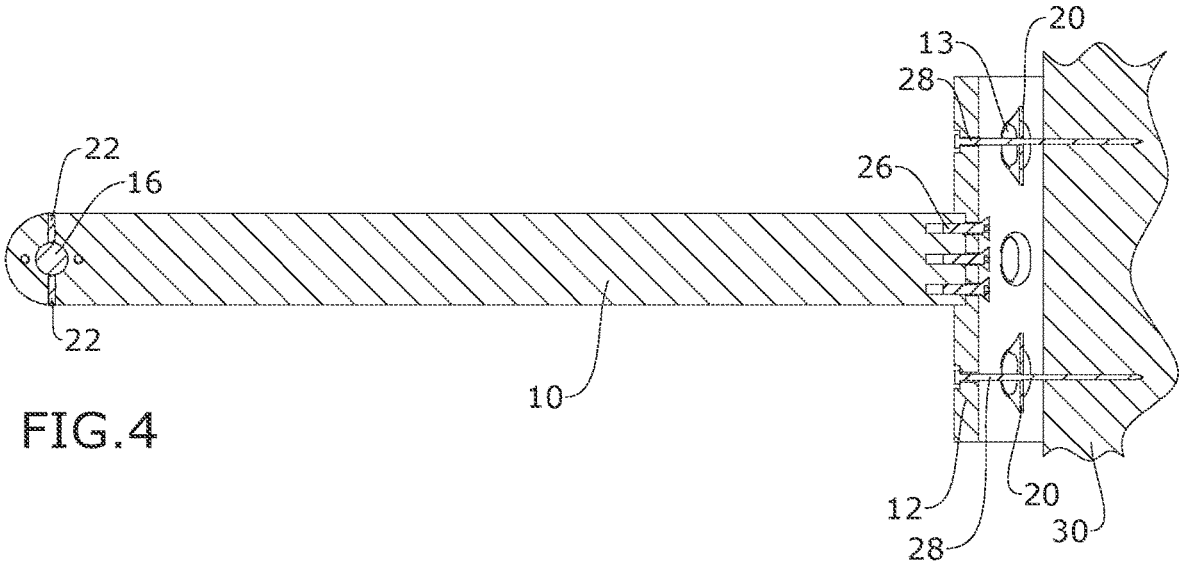
FIG. 4 is a sectional view of thereof, taken along line 4-4 in FIG. 1.
Figure 5:
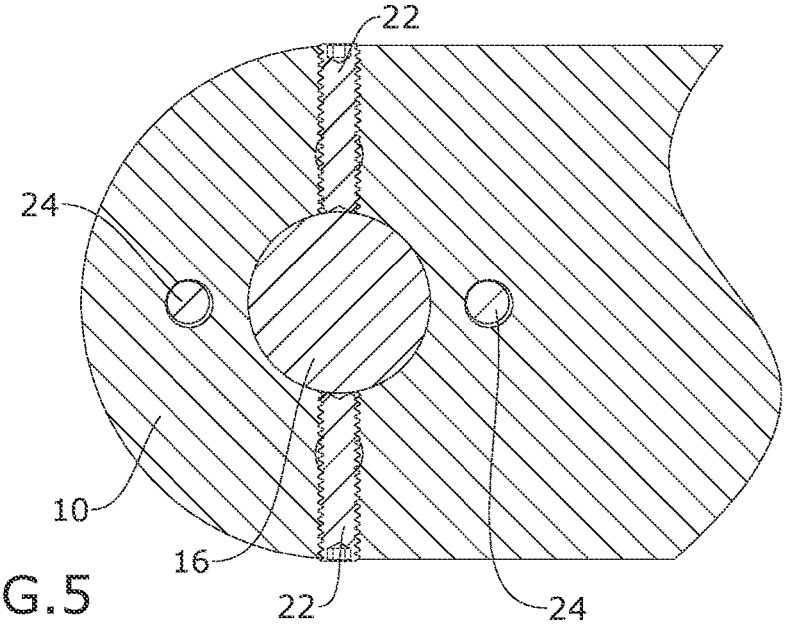
FIG. 5 is a detail view thereof.
Figure 6:
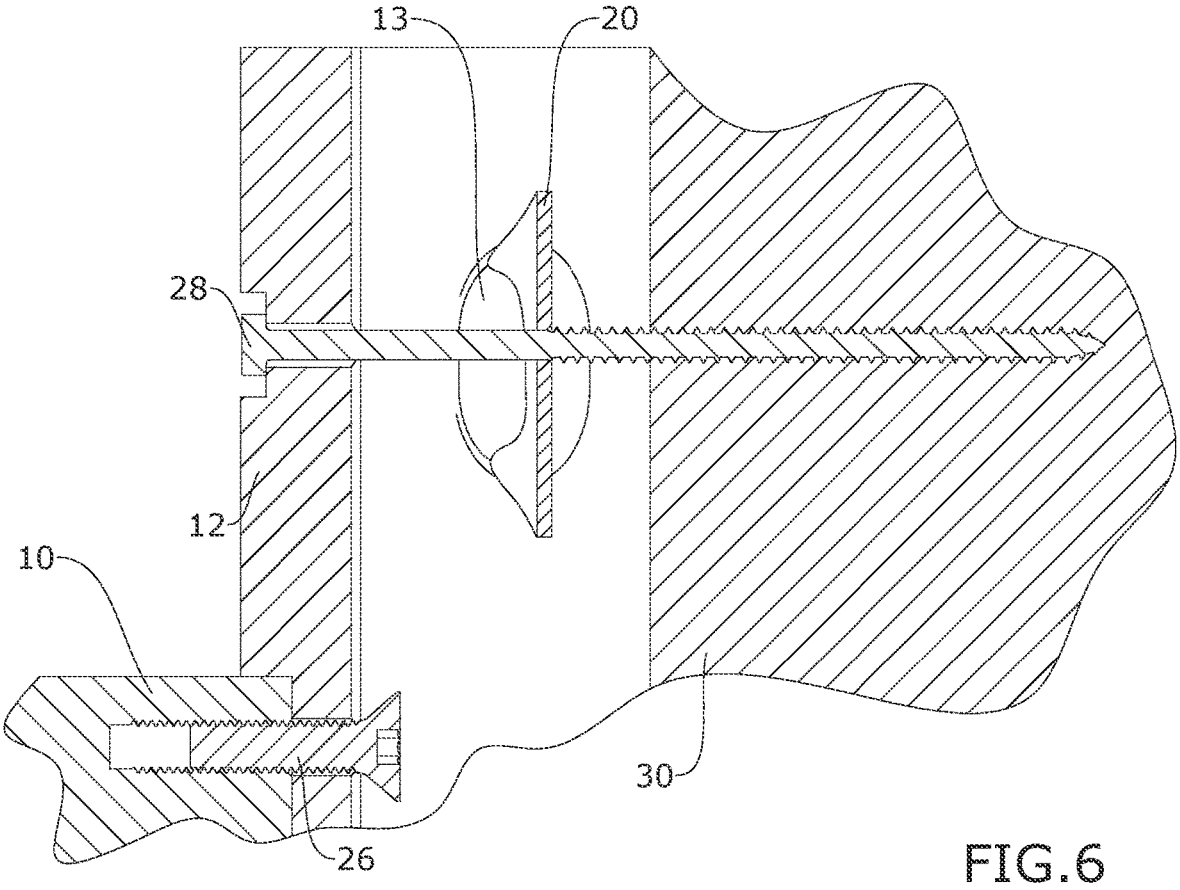
FIG. 6 is another detail view thereof.
Figure 7:
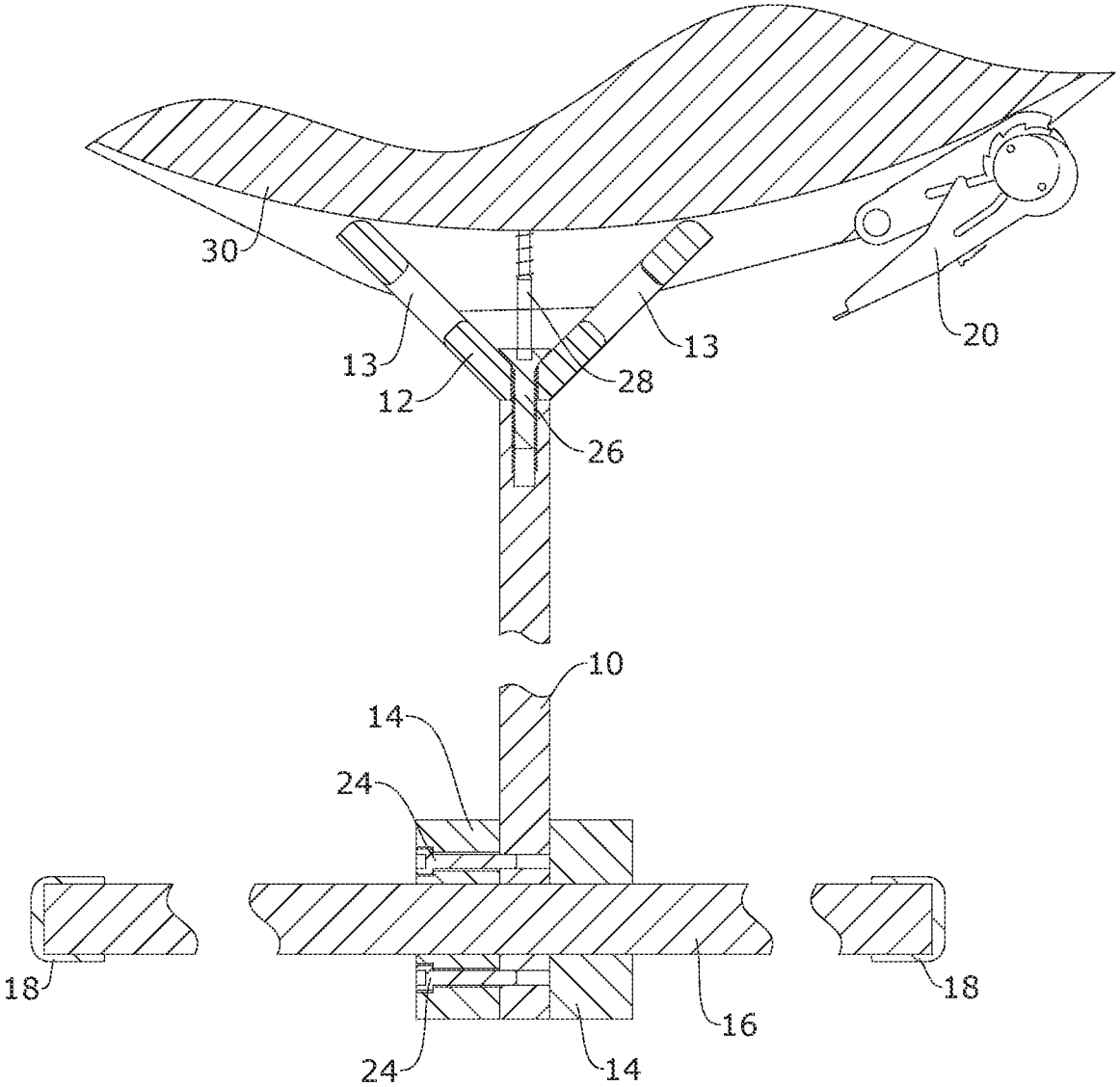
FIG. 7 is another sectional view thereof, taken along line 7-7 in FIG. 1.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a workout station comprising a base, a main beam, a bar, and collars. Generally, the base orients the station to be square and level to the ground. The main beam is preferably long and strong enough to support a person or persons and to keep the person(s) a safe distance from the tree or pole to which the workout station is mounted while working out. The two collars generally secure and support the bar to provide strength.

In some embodiments, the workout station may be attached to a tree or pole using mounting fasteners such as ratchet straps and/or lag bolts to secure it at a predetermined height. The sizes of the straps and bolts are not particularly limited. For example, about 2-inch×about 16-foot ratchet straps and about ⅜×about 6-inch-long lag bolts may be used.

In some embodiments, end caps are provided to hold abdominal straps and prevent them from slipping off the workout station when the bar is in a horizontal position.

The materials and method of manufacture are not particularly limited. For example, the components may be made from a metal such as aluminum. The base material may be cut to length. The base may be a metal bracket with a 90° bend centered vertically. Slots may be milled into the base or bracket and a 45-degree cutter may be used. About 5 through-holes or apertures may be drilled through the base. The main beam may be cut to length with two elongated parallel planar surfaces, milled to radius a rounded end, and a bolt hole, e.g., about ¼"-20 threads per inch (TPI), may be drilled through the stock. The opposing planar end may be machined square to length, drilled, and tapped with holes or apertures, e.g., about ⅜"-16 TPI, for fastening hardware. The round bar may be an elongated, cylindrical, metal rod cut to length. Both ends may be faced off, drilled, and tapped e.g., about ¼"-20 TPI by 0.75" deep. The outer diameter may be filed and polished so there are no burrs or high spots. The bar may slip into the main beam, may be centered, and may be held in a stationary position with set screws about 180 degrees apart, i.e., the set screws pass through opposing surfaces to bear against the bar, locking it in place. The size of set screw is not particularly limited. For example, about 5/16"-18 thread pitch set screws may be used. The collars slip over each end of the bar adjacent the elongated parallel planar surfaces of the main beam and screw in place, for example, with about ⅜" diameter—16 thread pitch socket head cap screws (SHCS) and/or about ¼" diameter—20 thread pitch SHCS, although the screws are not particularly limited.

The inventive workout station may be installed to a tree or pole at a predetermined location by the following method. The user may drill one hole, e.g., with an about 5/16" long drill, approximately four inches deep in a tree or pole. The user may insert a lag bolt through the top of the workout station and tighten it to the tree or pole. Once the bar is adjusted to a level position, the user may drill a second hole using the hole in the base as a guide. A lag bolt may be inserted through the second hole and tightened as well. Two or more ratchet straps may be positioned around the tree or pole and the base and may be tightened to secure the workout station in place.

Referring to FIGS. 1 through 8, a workout station according to an embodiment of the present invention is shown in FIG. 1, comprising a main beam 10 extending from a main body 12 and held in place with main beam screws 26. At an opposite end of the main beam 10, support collars 14 support a bar 16 perpendicularly to the main beam 10. The bar 16 is shown with endcaps 18 at each end. Ratchet straps 20 may be installed through strap openings 13 (better shown in FIGS. 2 and 7) and lag bolts 28 may be inserted through the main body 12, as better shown in FIGS. 4 and 6, to hold the workout station to a tree 30. As best shown in FIGS. 3-5 and 7, set screws 22 and collar screws 24 hold the bar 16 in place in the main beam 10.

Figure 8:
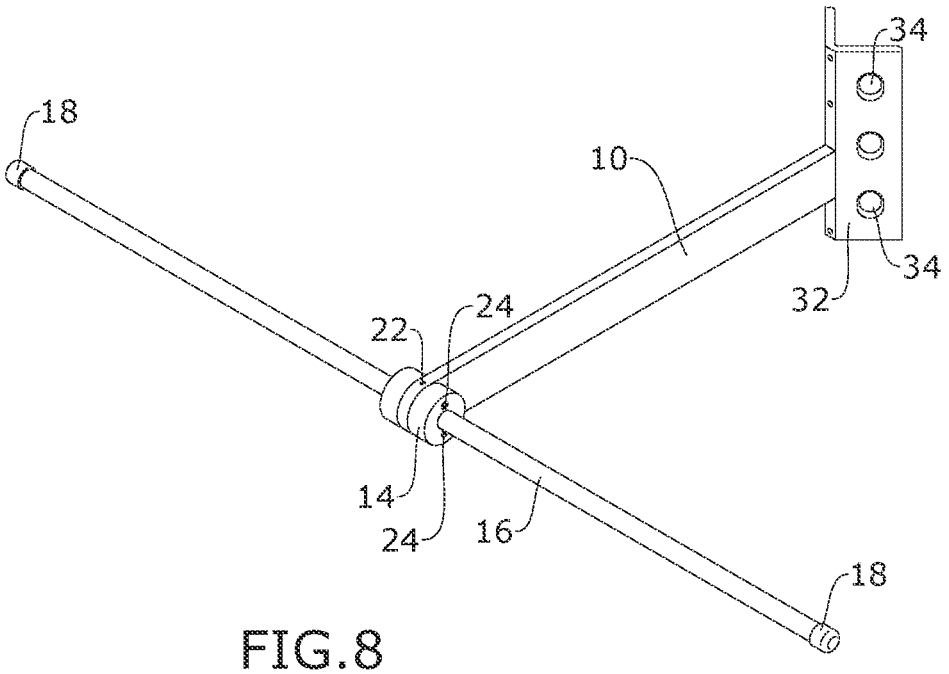
FIG. 8 is a perspective view of a workout station according to another embodiment of the present invention.

A workout station according to another embodiment of the present invention is shown in FIG. 8. In this embodiment, the main beam 10 is mounted to the main body 12 on a lower half, or first half, thereof with respect to a mounted orientation. The lowered main beam 10 enables the user to install both ratchet straps 20 above the beam (and above the point at which a downward force is exerted on the main beam 10 by the exerciser) on a second half of the main body, contributing substantial strength to the device.

It should be understood, of course, that the foregoing relates to exemplary embodiments of the invention and that modifications may be made without departing from the spirit and scope of the invention as set forth in the following claims.

What is claimed is:

1. A workout station, comprising:

a. a main body;

b. a main beam extending from the main body;

c. a bar extending perpendicularly through the main beam opposite the main body;

d. mounting fasteners extending through the main body and operative to fasten the workout station to a vertical substrate;

wherein the main body, the main beam, the bar, and the mounting fasteners are operative to support a user hanging from the bar, wherein the main beam has two elongated parallel planar surfaces with a rounded end and a planar end, with apertures at each end; and e. collars around the bar adjacent to the elongated parallel planar surfaces of the main beam, wherein collar screws fasten the collars to the main beam and set screws pass through opposing surfaces of the main beam to bear against the bar such that the bar is retained in a stationary position.

2. The workout station of claim 1, wherein the main body comprises a metal bracket with a 90° bend centered vertically therein and the main body has a plurality of apertures.

3. The workout station of claim 1, wherein the main beam is fastened to the main body with fastening hardware.

4. The workout station of claim 3, wherein the main beam is fastened to a first half of the main body and the mounting fasteners extend through a second half of the main body.

5. The workout station of claim 1, wherein the bar is an elongated cylindrical metal rod.

6. The workout station of claim 1, wherein the bar further comprises end caps operative to prevent a strap from sliding off the bar when the bar is in a horizontal position.

7. The workout station of claim 1, wherein the mounting fasteners are selected from the group consisting of ratchet straps, lag bolts, and combinations thereof.

* * * * *